US007131297B2

(12) United States Patent
Choi

(10) Patent No.: US 7,131,297 B2
(45) Date of Patent: Nov. 7, 2006

(54) CANVAS CLEANING APPARATUS FOR USE IN PAPER MILL

(76) Inventor: Kwan Yong Choi, Daelim Apt. 101-401, 702-22, Chojeon-Dong, Jinju-City, Kyungnam (KR)

( * ) Notice: Subject to any disclaimer, the term of this patent is extended or adjusted under 35 U.S.C. 154(b) by 159 days.

(21) Appl. No.: 10/989,861

(22) Filed: Nov. 15, 2004

(65) Prior Publication Data

US 2005/0087218 A1 Apr. 28, 2005

(51) Int. Cl.
*D06B 3/20* (2006.01)

(52) U.S. Cl. ..... 68/205 R; 15/302; 15/320

(58) Field of Classification Search ..... 68/200, 68/205 R; 15/302, 320, 322
See application file for complete search history.

(56) References Cited

U.S. PATENT DOCUMENTS

| | | | | |
|---|---|---|---|---|
| 1,736,633 | A * | 11/1929 | Schutte | 118/50 |
| 2,888,378 | A * | 5/1959 | Maguire | 162/210 |
| 3,357,111 | A * | 12/1967 | Fleissner et al. | 34/115 |
| 3,402,101 | A * | 9/1968 | Schiel | 162/358.1 |
| 3,469,932 | A * | 9/1969 | Heinz | 8/151 |
| 3,503,134 | A * | 3/1970 | Heinz | 28/167 |
| 3,806,405 | A * | 4/1974 | Heidweiller | 162/186 |
| 3,931,682 | A * | 1/1976 | Candor | 34/252 |
| 4,913,346 | A | 4/1990 | Nakamura et al. | 239/225.1 |
| 5,381,580 | A | 1/1995 | Kotitschke et al. | 15/302 |
| 5,783,044 | A | 7/1998 | Schneider et al. | 162/278 |
| 6,099,691 | A | 8/2000 | Clarke et al. | 162/279 |

FOREIGN PATENT DOCUMENTS

| | | | |
|---|---|---|---|
| DE | 198 40 021 | * | 3/2000 |
| JP | 01168367 | A2 | 4/1990 |
| JP | 2002-282803 | A | 10/2002 |

OTHER PUBLICATIONS

European Patent Office 0 756 034 Jan. 1996.*
European Patent Office 1 361 307 Mar. 1999.*
International Search Report, Jun. 25, 2004.

* cited by examiner

*Primary Examiner*—Frankie L. Stinson
(74) *Attorney, Agent, or Firm*—St. Onge Steward Johnston & Reens LLC

(57) ABSTRACT

Disclosed is a canvas cleaning apparatus for use in a paper mill. The apparatus includes a main injection unit for injecting cleaning water having an injection head moved from side to side, an auxiliary injection unit for injecting the cleaning water enclosing the injection head of the main injection unit and having a permanent magnetic fixed to one end thereof, an auxiliary suction unit for sucking cleaning water and wastes installed at a position opposed to the main injection unit and having a permanent magnet fixed to one end thereof, and a main suction unit for sucking cleaning water and wastes fixed to the auxiliary suction unit.

2 Claims, 10 Drawing Sheets

CANVAS CLEANING APPARATUS FOR USE IN PAPER MILL

This application claims priority of pending International Patent Application No. PCT/KR2003/001964 filed on Sep. 25, 2003 designating the United States.

TECHNICAL FIELD

The present invention relates to a canvas cleaning apparatus for use in a paper mill, and more particularly, to a canvas cleaning apparatus capable of improving a cleaning function of a canvas and also preventing a secondary contamination of the canvas and periphery equipments by sucking cleaning water injected to the canvas by a cleaning water injection unit through a desired unit.

BACKGROUND ART

In general, a canvas and a felt are necessary units to be used in a process of making paper in a paper mill. The canvas is constructed in shape of sheet or conveyer made of a fiber, a mesh or the like.

In the canvas, pulp particles are held in holes formed by warps and wefts. Since the particles are stuck to the holes after lapse of some times, it impedes the manufacture of a high quality of paper.

In order to solve the above problem, a cleaning system has been proposed to detach the pulp particles from the canvas by injecting pressurized water into a surface of the rotating canvas by use of a conventional cleaning water injecting unit with an injection head install thereto.

A rectangular container is disposed on the left of the canvas for collecting and discharging the wastes detached from the canvas and the cleaning water.

With such a conventional cleaning system, the pressurized water injected at high pressure from the injection head collides with the surface of the canvas and thus is scattered together with wastes in the air. Further, the wastes detached from the canvas collide with the container and thus is scattered in all directions. Accordingly, a main roller and an auxiliary roller are secondarily contaminated, as well as the canvas, thereby impeding the manufacture of a high quality of paper.

Specifically, the conventional cleaning system has a disadvantage in that the wastes mixed with the waterdrops are scattered in the air by the pressure of the cleaning water injected at high pressure from the injection head to degrade a cleaning function of the canvas and to contaminate peripheral equipments.

In addition, the conventional injection head has the following problems. First, a construction of the conventional injection head will now be described in brief.

The conventional injection head includes a coupler connected to a pressurized water supplying pipe, an adaptor for assembling the coupler and a shaft, and a rotator adapted to rotate in one direction on the shaft. A pressurized water supplying passage and holes are formed in an interior of the shaft, and the rotator is mounted on the shaft.

Since the rotator is adapted to rotate in one direction only, there is a disadvantage that the entire surface of the canvas does not uniformly cleaned. It should increase or decrease a revolution of the rotator injecting the cleaning water so as to insure maximum cleaning of the canvas. At that time, the conventional injection head controls the revolution of the rotator of the injection head by increasing or decreasing the pressure of the pump supplying the pressurized water to adjust the supplying pressure of the pressurized water. Such a system deteriorates the durability of the pump since the pump is loaded. In addition, in the case the revolution of the rotator is accelerated by increasing the pressure of the pump, the pressure of the pressurized water injected through injection nozzles 7*d* is decreased, thereby adversely affecting the system. When the conventional injection head is used, it is very difficult to easily adjust the revolution of the rotator.

DISCLOSURE OF THE INVENTION

Therefore, an object of the present invention is to solve the problems involved in the prior art, and to provide a canvas cleaning apparatus for use in a paper mill capable of collecting and discharging waterdrops splashed from a surface of a canvas and wastes detached from the surface of the canvas, the waterdrops resulted from injection of cleaning water injected by an injection head.

Another object of the present invention is to provide an injection head of a canvas cleaning apparatus, in which an outer rotator and an inner rotator are rotated in a reverse direction to each other to inject cleaning water.

Further another object of the present invention is to provide an injection head of a canvas cleaning apparatus, in which revolutions of outer and inner rotators can be controlled by adjusting a distance between a magnetic ring fixed to one outer stator and a magnetic ring fixed to one inner stator and a distance between a magnetic ring fixed to the other outer stator and a magnetic ring fixed to the other inner stator.

In order to accomplish the above and other objects, there is provided a canvas cleaning apparatus for use in a paper mill, the apparatus comprising: a main injection unit for injecting cleaning water installed to a base frame supporting a canvas which is rotated in contact with a main roller and an auxiliary roller, and including a rectangular housing having a length longer than that of the canvas, a reduction gear, installed to a motor installed in a housing, for reducing a rotating speed of the motor, a slider fixed to a wire wound around a sieve rotated by the reduction gear and moved from side to side along a rail installed horizontally, a bracket fixed to the slider, a caterpillar for protecting a suction hose, a cable and a pressurized water supplying pipe, and an injection head connected to the pressurized water supplying pipe; an auxiliary injection unit for injecting the cleaning water, including a bracket fixed to the bracket of the main injection unit, a suction pipe welded to the bracket and connected to the suction hose for sucking waterdrops, which are injected at high pressure from the injection head and scattered from the canvas, to discharge the sucked waterdrops to the suction hose, a housing connected to the suction pipe, enclosing the injection head and having a hole formed toward a front portion of the injection head, and a supporting frame fixed to both sides of the housing and having a permanent magnet at one end thereof, wherein the auxiliary injection unit is moved from side to side together with the bracket; a main suction unit for sucking cleaning water and wastes installed at a position opposed to the main injection unit on the base frame supporting the canvas which is rotated in contact with a main roller and an auxiliary roller, and including a rectangular housing having a length longer than that of the canvas, a slider moved from side to side along a rail installed horizontally in the housing, a bracket fixed to the slider, and a caterpillar, fixed to the bracket, for protecting a suction hose, a cable and a high pressurized water supplying pipe; and an auxiliary suction unit for sucking cleaning water and wastes, including a bracket fixed to the bracket of the main suction unit, a suction pipe welded to the bracket and connected to the suction hose for sucking the waterdrops and the wastes passed through the canvas to discharge the sucked waterdrops and wastes to the suction hose, which the waterdrops are injected at high pressure from the injection head and scattered from the canvas, a housing connected to the suction pipe and having a hole for sucking the cleaning water injected from the injection head and the wastes detached from the canvas by the cleaning water in large quantities, and a supporting frame fixed to both sides of the housing and having a permanent magnet at one end thereof, wherein the auxiliary suction unit is installed at a position opposite to the auxiliary injection unit.

The auxiliary suction unit and the auxiliary injection unit are faced to each other and moved from side to side at the same speed by magnetic force of the permanent magnet of the auxiliary suction unit and the permanent magnet of the auxiliary injection unit, with the canvas being interposed between the auxiliary suction unit and the auxiliary injection unit, and the cleaning water injected from the injection head and the wastes detached from the canvas are sucked and discharged through the auxiliary suction unit and the auxiliary injection unit.

With the injection head of the present invention, a cleaning function is improved by rotating the inner rotator and the outer rotator in reverse direction to each other. Revolutions of the outer stator and the inner stator may be easily controlled by adjusting distances between the magnetic rings fixed to the outer stators and the inner stators.

BRIEF DESCRIPTION OF DRAWINGS

The above objects, other features and advantages of the present invention will become more apparent by describing the preferred embodiment thereof with reference to the accompanying drawings, in which.

BEST MODE FOR CARRYING OUT THE INVENTION

Reference will now be made in detail to preferred embodiments of the present invention, examples of which are illustrated in the accompanying drawings.

A canvas cleaning apparatus according one preferred embodiment of the present invention includes a main injection unit 30 for injecting cleaning water, an auxiliary injection unit 40 for injecting the cleaning water, a main suction unit 60 for sucking the cleaning water and wastes, and an auxiliary suction unit 50 for sucking the cleaning water and wastes.

Figure 2:
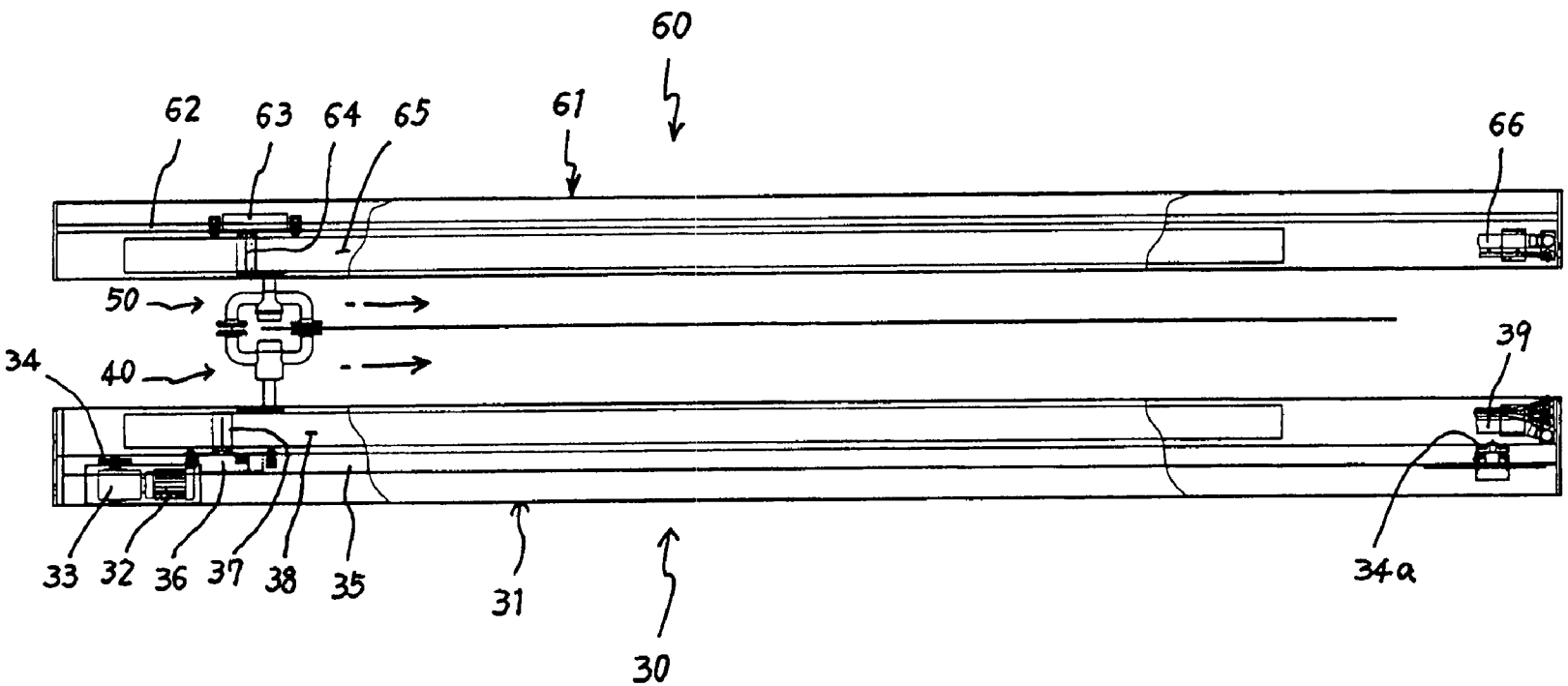
FIG. 2 is a top plan view showing an operating state of a canvas cleaning apparatus according to a preferred embodiment of the present invention.
Figure 3:
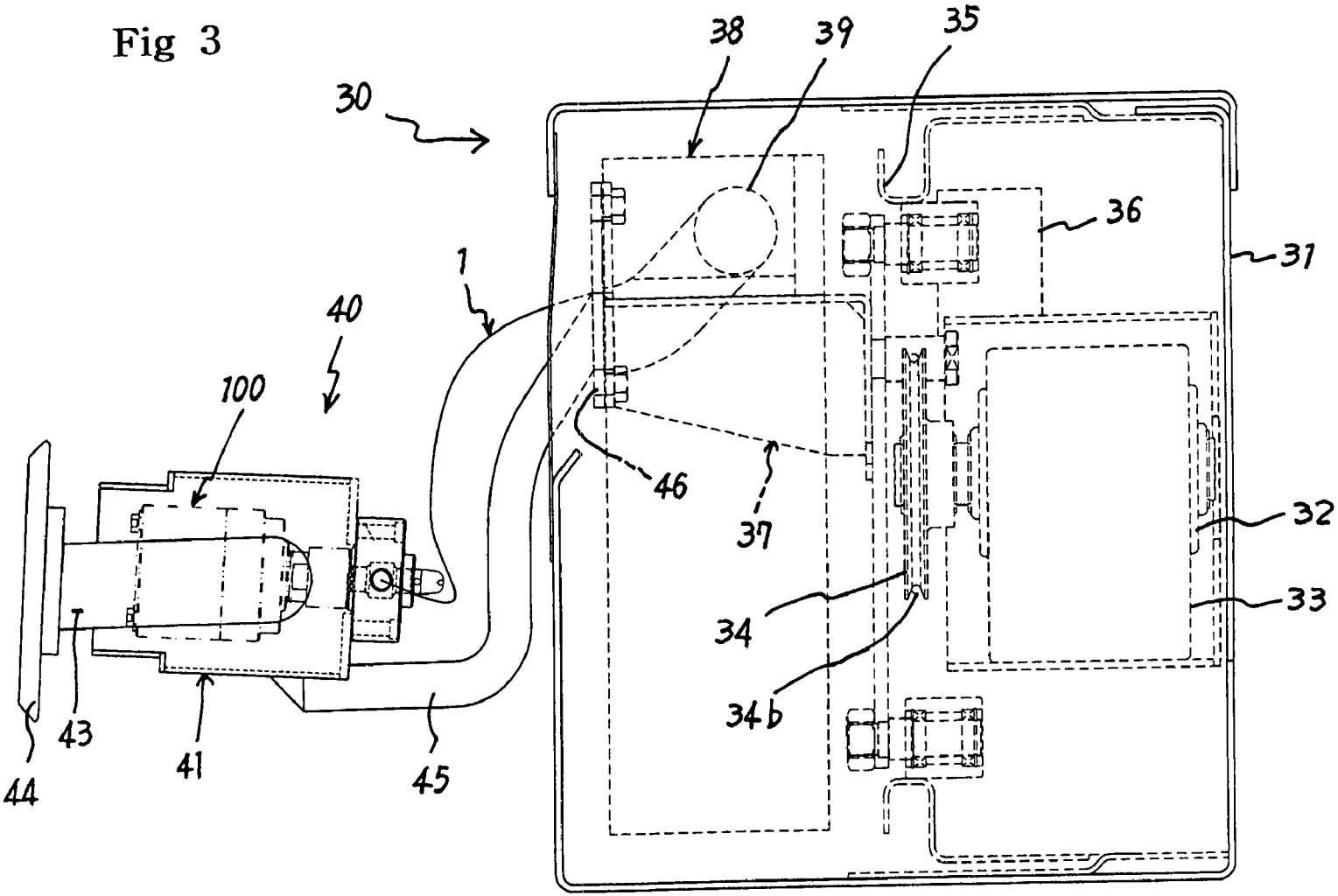
FIG. 3 is a schematic view of a cleaning water injection unit of the present invention.
Figure 4:
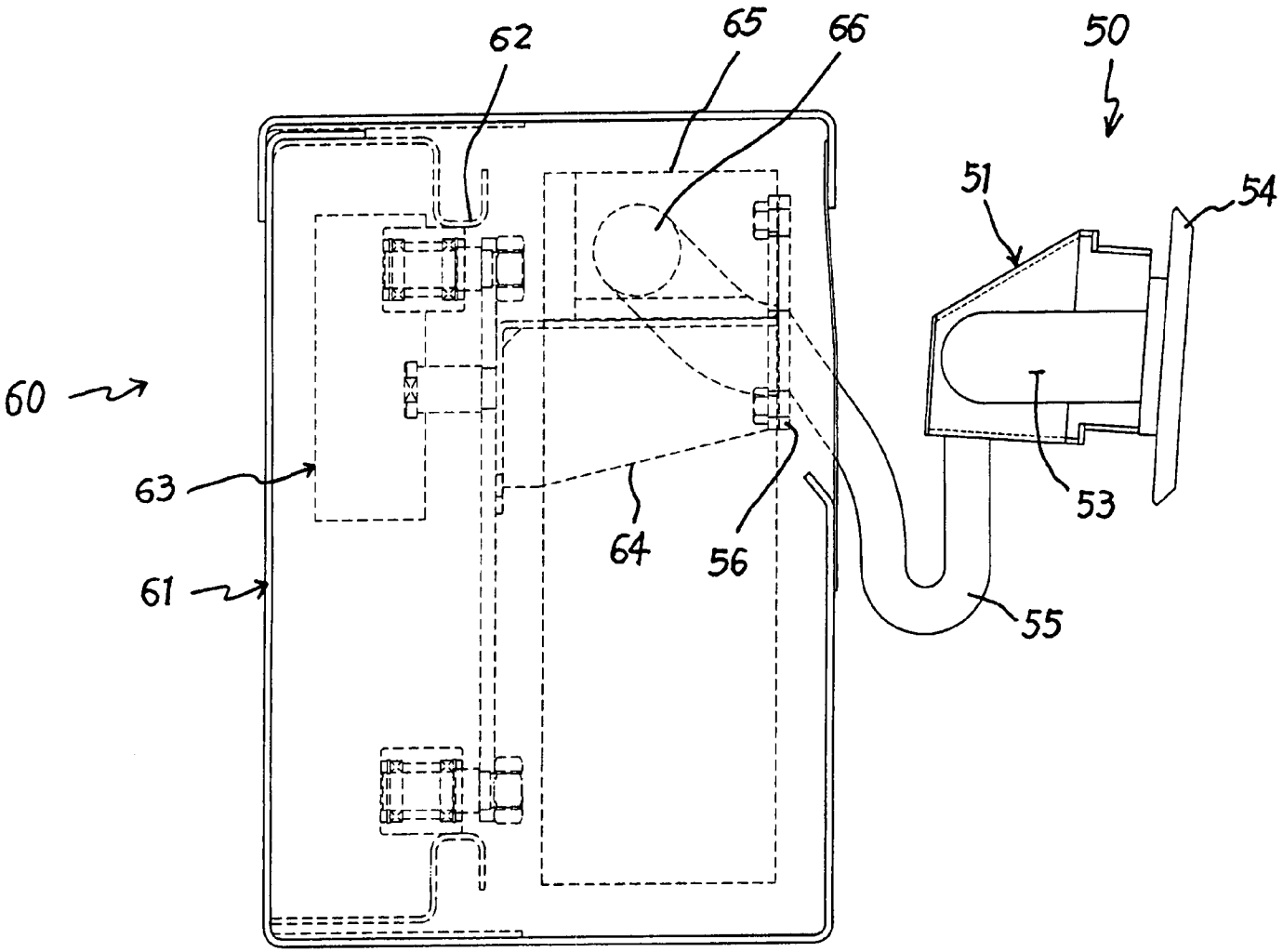
FIG. 4 is a schematic view of a main suction unit for sucking cleaning water and wastes according to the present invention.
Figure 5:
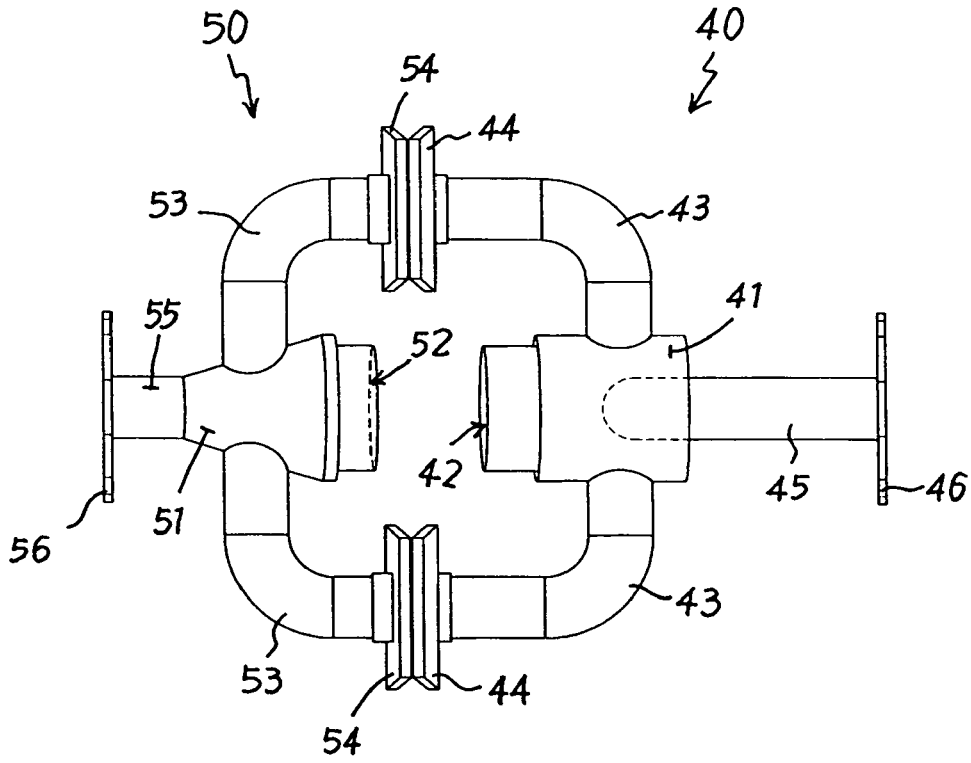
FIG. 5 is a schematic view of an auxiliary suction unit for sucking cleaning water according to the present invention.
Figure 6:
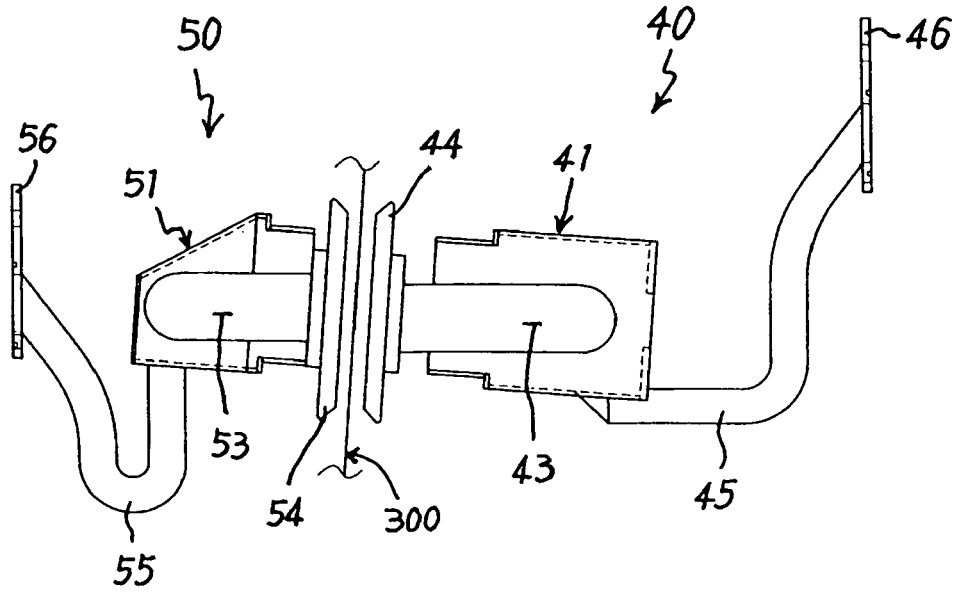
FIG. 6 is a front view of FIG. 5.

The main injection unit 30 for injecting the cleaning water is installed to a base frame 70 supporting a canvas 300 which is rotated in contact with a main roller 210 and an auxiliary roller 200. The main injection unit 30 includes, as shown in FIG. 2, a rectangular housing 31 having a length longer than that of the canvas 300. A motor 32 is fixed to an interior of the housing, and a reduction gear 33 is installed to the motor 32 to reduce a rotating speed of the motor.

In addition, the main injection unit 30 includes a slider 36 fixed to a wire 34*b* wound around sieves 34 and 34*a* rotated by the reduction gear 34 and moved from side to side along a rail 35 installed horizontally. A bracket 37 is fixed to the slider 36. Also, the bracket 37 is fixed to one side of a caterpillar 38 for protecting a suction hose 39, a cable and a gh pressurized water supplying pipe 1. The pressurized water supplying pipe 1 is connected to an injection head 100. The construction of main injection unit of the present invention is substantially similar to that of a conventional injection unit for injecting cleaning water, except for the suction hose 39.

The auxiliary injection unit 40 for injecting the cleaning water includes a bracket 46 fixed to the bracket 37 of the main injection unit 30, a suction pipe 45 welded to the bracket 46 and connected to the suction hose 39 for sucking waterdrops, which are injected at high pressure from the injection head 100 and scattered from the canvas 300, through a housing 41 to discharge the sucked waterdrops to the suction hose 39, the housing 41 connected to the suction pipe 45, enclosing the injection head 100 and having a hole 42 formed toward a front portion of the injection head 100, and a supporting frame 43 fixed to both sides of the housing 41 and having a permanent magnet 44 at one end thereof.

The auxiliary injection unit 40 is coupled to the bracket 37, and is moved from side to side together with the bracket 37 moved by the motor 32. The reason why the auxiliary injection unit 40 is installed is that, first, it drives the auxiliary suction unit 50 and, second, it guides the waterdrops, which are injected at high pressure from the injection head 100 and scattered from the surface of the canvas 300, through a housing 41 and the suction pipe 45 to the suction hose 39, without scattering the waterdrops in the air.

Figure 1:
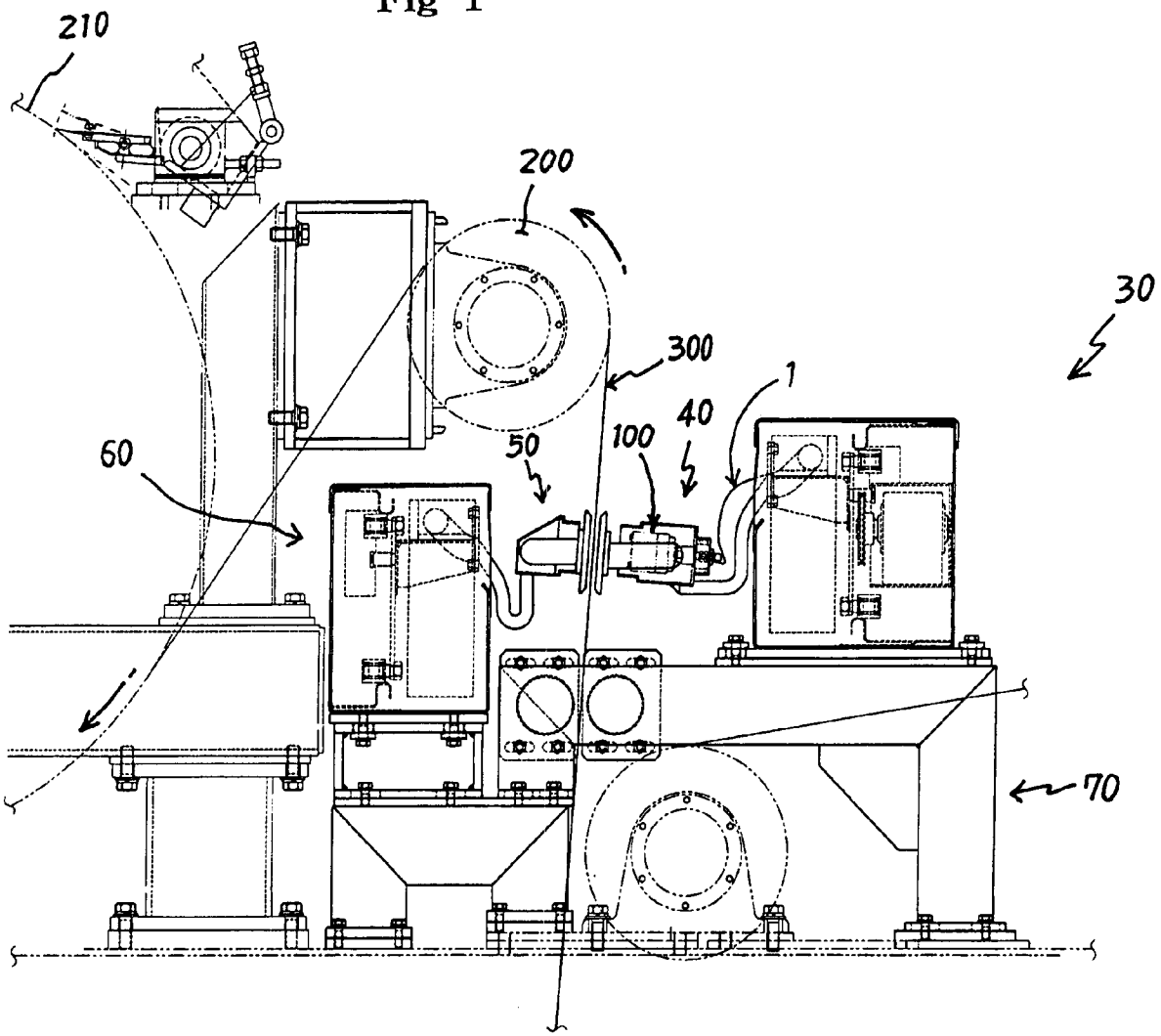
FIG. 1 is a schematic view showing an operating state of a canvas cleaning apparatus according to a preferred embodiment of the present invention.

The main suction unit 60 for sucking the cleaning water and wastes is installed at a position opposed to the main injection unit 30 on the base frame 70, as shown in FIG. 1, in which the canvas 300 is interposed between the housing 61 and the main injection unit 30. The main suction unit 60 includes a rectangular housing 61 having a length longer than that of the canvas 300, a slider 63 moved from side to side along a rail 62 installed horizontally in the housing 61, a bracket 64 fixed to the slider 63, and a caterpillar 38, fixed to the bracket 64, for protecting a suction hose 66, a cable and a pressurized water supplying pipe. The main suction unit sucks and discharges the cleaning water sucked through the auxiliary suction unit 50 and wastes detached from the surface of the canvas 300 through the suction hose 66.

The auxiliary suction unit 50 for sucking the cleaning water and wastes includes a bracket 56 fixed to the bracket 64 of the main suction unit 60, a suction pipe 55 welded to the bracket 56 and connected to the suction hose 66 for sucking the waterdrops and the wastes passed through the canvas to discharge the sucked waterdrops and wastes to the suction hose 66, which the waterdrops are injected at high pressure from the injection head 100 and scattered from the canvas 300, the housing 51 connected to the suction pipe 55 and having a hole 52 for sucking the cleaning water injected from the injection head 100 and the wastes detached from the canvas 300 by the cleaning water in large quantities, and a supporting frame 53 fixed to both sides of the housing 51 and having a permanent magnet 54 at one end thereof. The auxiliary suction unit 50 is installed to the main suction unit 60, as shown in FIG. 1.

With the construction described above, since the bracket 37 is moved from side to side by the motor 32 of the main injection unit 30, the auxiliary injection unit 40 fixed to the bracket 37 is also moved from side to side. The auxiliary suction unit 50 and the auxiliary injection unit 40 are faced to each other and moved from side to side at the same speed by the magnetic force of the permanent magnet 54 of the auxiliary suction unit 50 and the permanent magnet 44 of the auxiliary injection unit 40, with the canvas 300 being interposed between the auxiliary suction unit 50 and the auxiliary injection unit 40. At that time, the cleaning water injected from the injection head 100 and the wastes detached from the canvas 300 are sucked and discharged through the auxiliary suction unit 50 and the auxiliary injection unit 40.

The scattered waterdrops and wastes resulted by injecting the pressurized cleaning water against the canvas are collected by the suction pipe 45 of the auxiliary injection unit 40 and the suction hose 38 of the main injection unit 30. Accordingly, the cleaning apparatus of the present invention removes almost the waterdrops scattered from the canvas 300 and the wastes detached from the canvas 300, thereby solving the problem of secondarily contaminating the canvas 300 or contaminating periphery equipments.

The main suction unit 60 of the present invention is to discharge the cleaning water and the wastes through the suction hose 66, in state of supporting the auxiliary suction unit 50 driven by the magnetic force of the permanent magnet 54 of the auxiliary suction unit 50 and the permanent magnet 44 of the auxiliary injection unit 40 moved from side to side.

Since, among components of the main injection unit 30 and the main suction unit 60, the rails 35 and 62, the sliders 36 and 63, the brackets 37 and 64, the caterpillars 38 and 65 are widely known in the art, the detailed description thereof will be omitted herein.

The operation of the injection head 100 of the present invention will now be described in detail.

Figure 7:
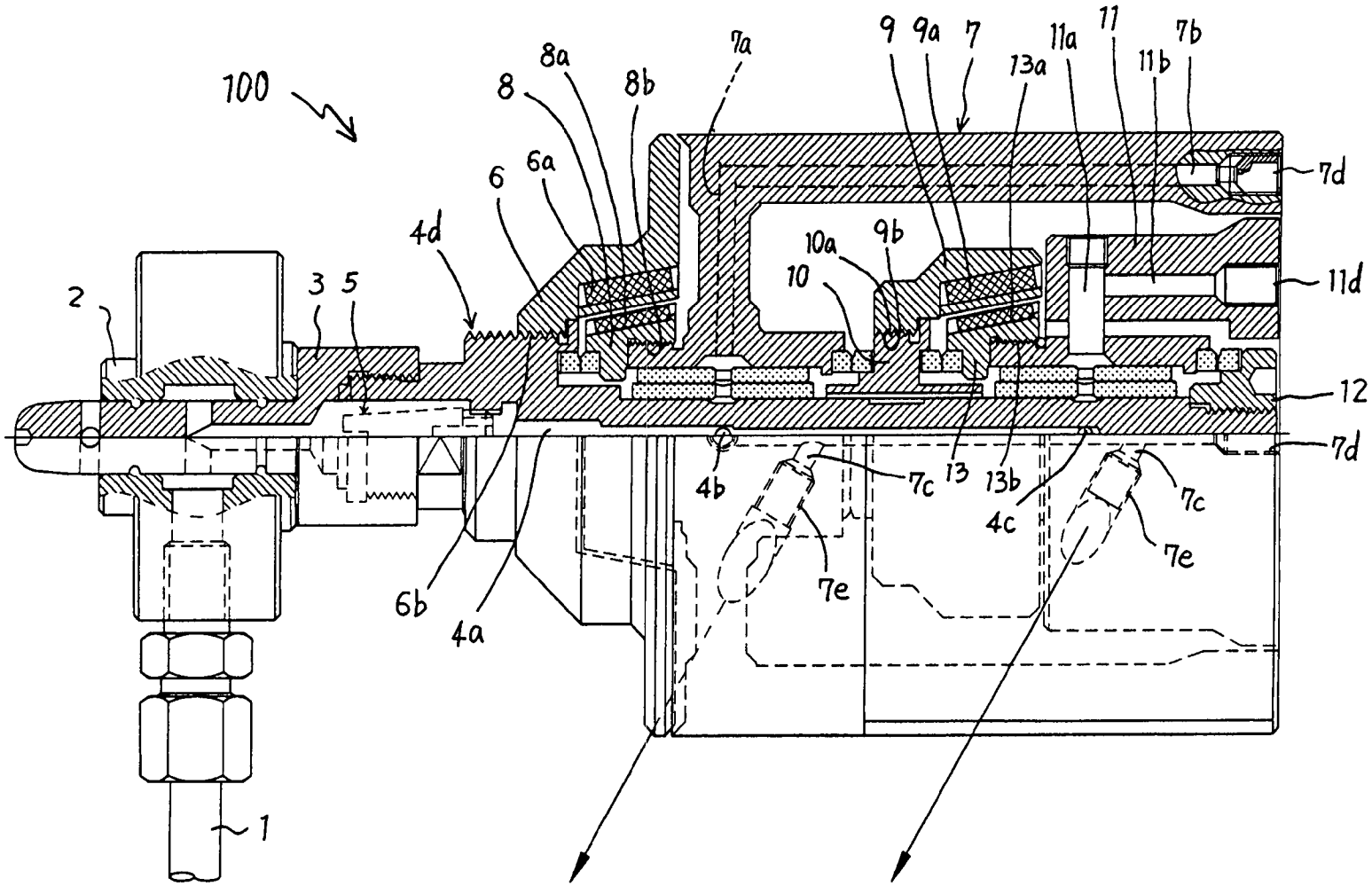
FIG. 7 is a cross-sectional view of an injection head of the present invention.

The pressurized water supplied from a unit for supplying the pressurized water is fed into a pressurized water supplying passage 4*a* of a shaft 4 and holes 4*b* and 4*c* formed in the passage 4*a* through the pressurized water supplying pipe 1, as shown in FIG. 7. A coupler 2 is assembled to an adapter 3 to supply the pressurized water into the shaft 4. A filter 5 is inserted in the pressurized water supplying passage 4*a* of the shaft to eliminate alien substances. Preferably, a high quality of filter is used to filter fine alien substances. As shown in FIG. 7, since the holes 4*b* and 4*c* are formed on the pressurized water supplying passage 4*a* of the shaft, the pressurized water is supplied to first passages 7*a* of the outer rotator 7 and second passages 11*a* of an internal rotary 11.

Figure 8:
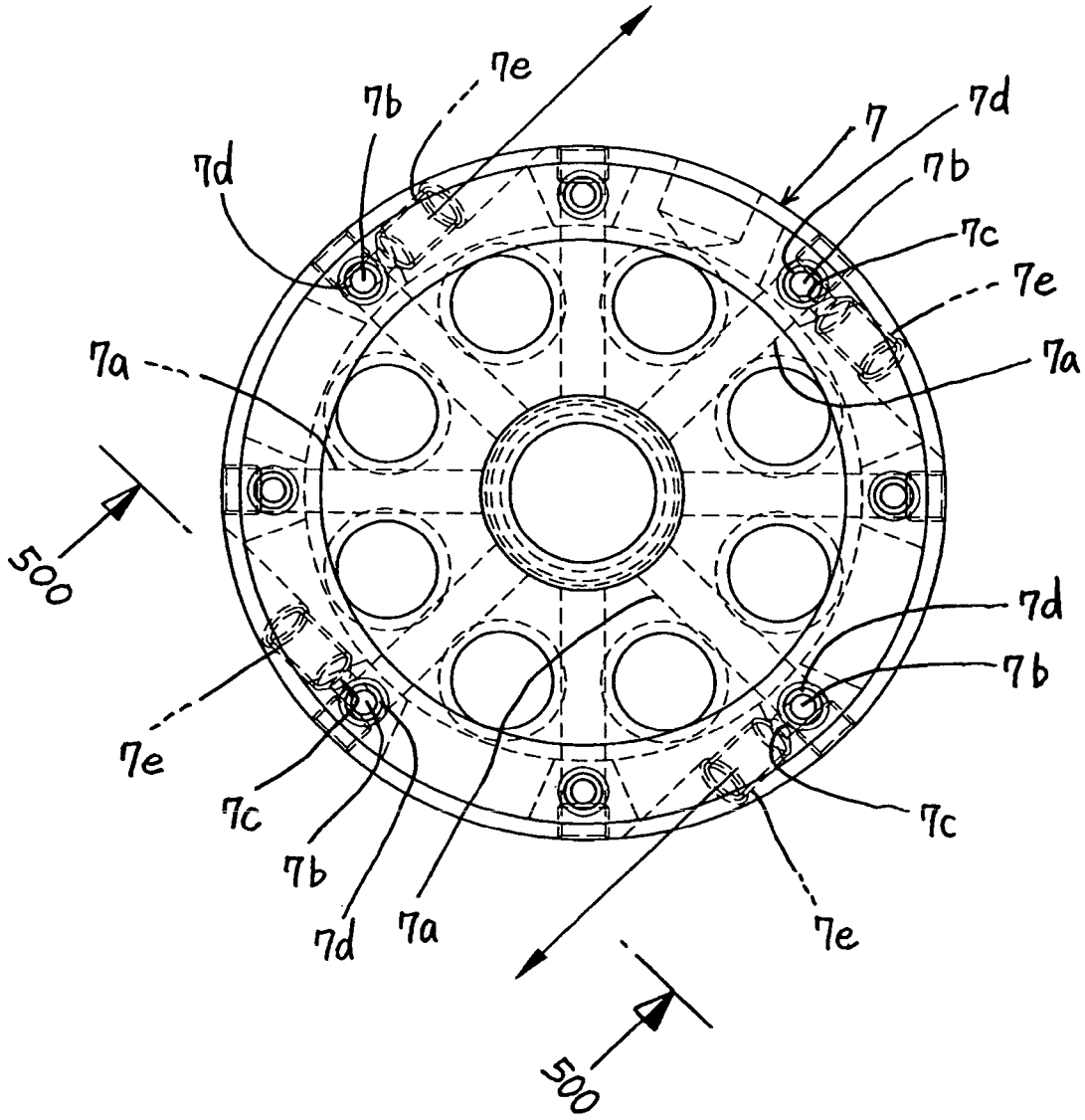
FIG. 8 is a right side view of an outer rotator shown in FIG. 7.
Figure 10:
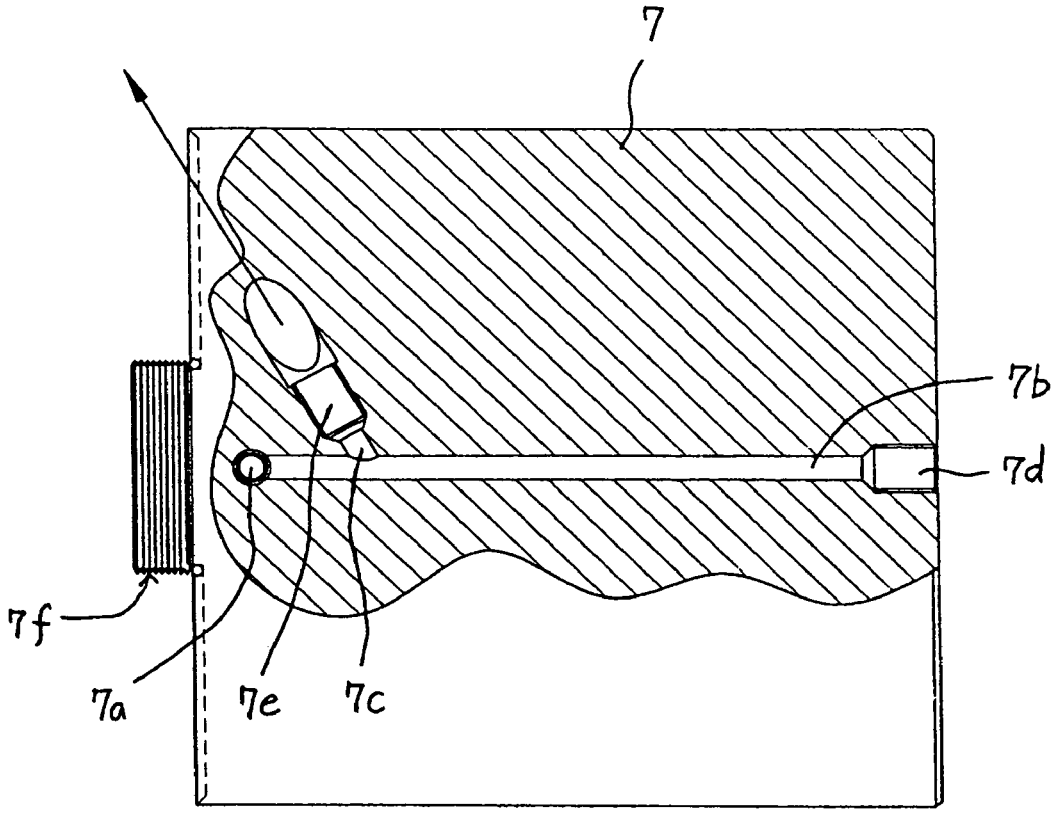
FIG. 10 is a cross-sectional view taken along a line 500—500 in FIG. 8.

Referring to FIG. 7, the first passages 7*a* are radially formed on the outer rotator 7 assembled to the shaft 4, and second passages 7*b* are formed vertically to the first passages 7*a*. Third passages 7*c* slanted backward are formed in the two symmetrical passages of the first passages 7*a*, as shown in FIGS. 7, 8 and 10. A rotatable spray nozzle 7*e* is assembled to two third passages 7*c*, respectively. The pressurized water passed through the first and second passages 7*a* and 7*b* is injected to the canvas through injection nozzles 7*d*, and the pressurized water discharged through the third passages 7*c* is injected rearward through the spray nozzle 7*e*. In result, the outer rotator 7 is rotated in counterclockwise direction in FIG. 8.

A female threaded portion 8*b* of an inner stator 8 is threadly engaged to a threaded portion 7*f* of the outer rotator 7, as shown in FIG. 7. A magnetic ring 8*a* is engaged to an outer periphery of the inner stator 8. The magnetic ring 8*a* is formed in a shape of ring in the embodiment, but a plurality of magnets may be positioned around the periphery of the inner stator at regular intervals. Structure of magnetic rings 6*a*, 9*a* and 13*a* described hereinafter may be also applied in the same way as that of the magnetic ring 8*a*.

An outer stator 6 is assembled to the outer of the inner stator 8, as shown in FIG. 7. A male threaded portion 4*d* of the shaft 4 is threadly engaged to a female threaded portion 6*b* of the outer stator 6. The magnetic ring 6*a* fixed to the inner surface of the outer stator 6 is disposed adjacent to the magnetic ring 8*a* of the inner stator 8, as shown in FIG. 7. Since the magnetic rings 6*a* and 8*a* are disposed adjacent to each other in a slant state, as shown in FIG. 7, if the outer stator 6 is rotated left, the magnetic rings 6*a* and 8*a* are moved away from each other. Therefore, the magnetic force between the magnetic rings 6*a* and 8*a* is weakened, and thus a rotating speed of the outer rotator 7 is increased. On the contrary, if a distance between the magnetic rings 6*a* and 8*a* is shorten by rotating the outer stator 8 right to reduce the rotating speed of the outer rotator 7, the magnetic force between the magnetic rings 6*a* and 8*a* is increased, thereby reducing the rotating speed of the outer rotator 7.

A spacer 10 is assembled to the shaft 4 between the outer rotary 7 and the inner rotary 11, as shown in FIG. 7. A male threaded portion 10*a* of the spacer is threadly engaged to a female threaded portion 9*b* of another outer stator 9. The magnetic ring 9*a* is fixed to the outer stator 9, as the outer stator 8 described above.

Figure 9:
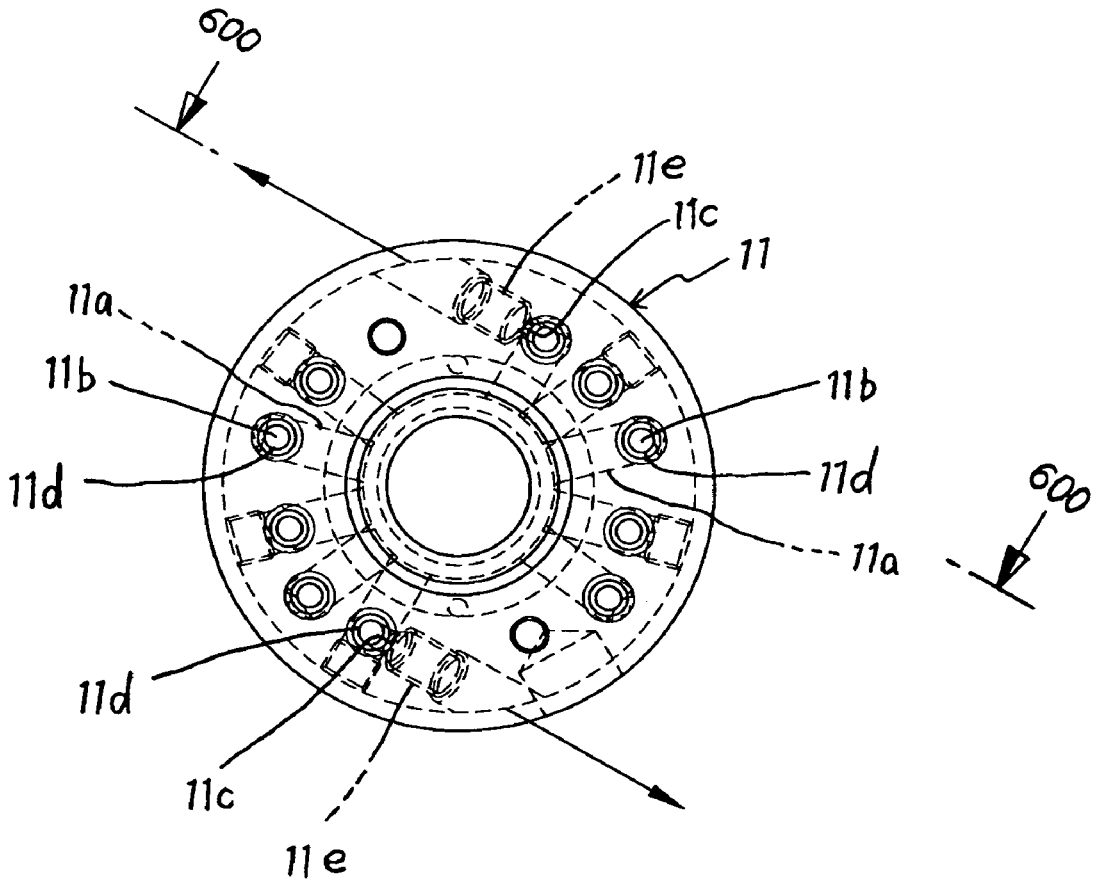
FIG. 9 is a right side view of an inner rotator shown in FIG. 7.
Figure 11:
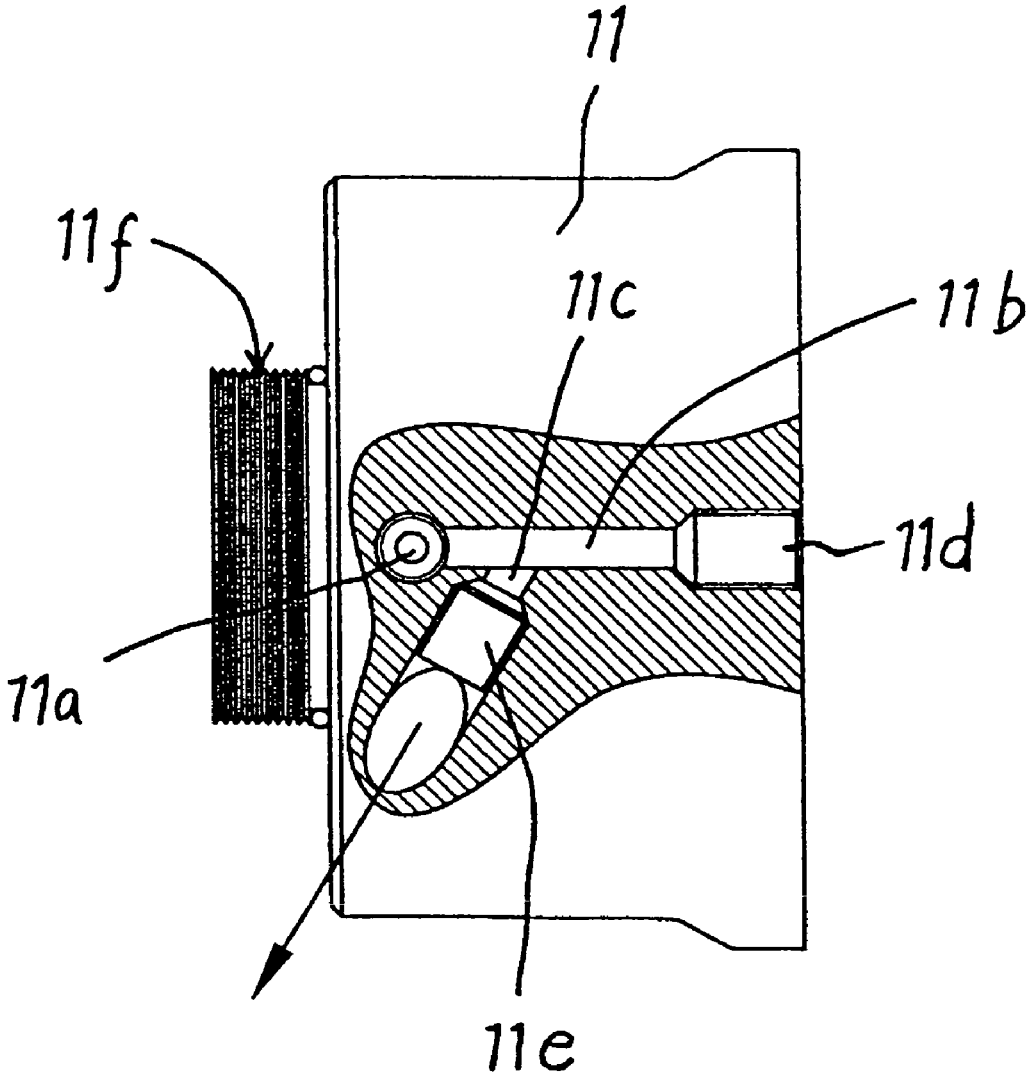
FIG. 11 is a cross-sectional view taken along a line 600—600 in FIG. 9.

First passages 11*a* are radially formed on the inner rotator 11, and second passages 11*b* are formed vertically to the first passages 11*a*. Third passages 11*c* slanted backward are formed in the two symmetrical passages of the first passages 11*a*, as shown in FIGS. 9 and 11. A rotatable spray nozzle 11*e* is assembled to two third passages 11*c*, respectively. The pressurized water passed through the first and second passages 11*a* and 11*b* is injected to the canvas through injection nozzles 11*d*, and the pressurized water discharged through the third passages 11*c* Is Injected rearward through the spray nozzle 11*e*. In result, the inner rotator 11 is rotated in counterclockwise direction in FIG. 9.

A female threaded portion 13*b* of an inner stator 13 is threadly engaged to a threaded portion 11*f* of the outer rotator 11, as shown in FIG. 7. The magnetic ring 13*a* is engaged to an outer periphery of the inner stator 13. As the outer stator 6 and the inner stator 8, a distance between the magnetic rings 9*a* and 13*a* is varied depending upon the left rotation or right rotation of the outer stator 9, so that a rotation speed of the inner rotator 11 may be increased or reduced. The inner rotator 11 and the shaft 4 are fixed by a nut 12.

The outer rotator 7 and the inner rotator 11 are assembled to the shaft 4 in such a way that the rotators are freely rotated, with a ceramic bushing interposed between the rotators and the shaft. Also, another ceramic bushing is interposed between the outer stator 6 and the inner stator 8, the outer rotator 7 and the spacer 10, the spacer 10 and the inner stator 13, and the inner rotator 11 and the nut 12, so as to freely rotate the components, except for the nut 12.

With the construction, while the outer rotator 7 is rotated in a counterclockwise direction, the pressurized water is injected to the upper surface of the canvas by the injection nozzles 7*d*. Further, while the inner rotator 11 is rotated in a clockwise direction, in other words, in a direction opposite to the rotating direction of the outer rotator 7, the pressurized water is injected to the upper surface of the canvas by the injection nozzles 11*d*. Accordingly, the inner and outer rotators supply the pressurized water to the canvas with strong shock in the same direction and opposite direction as the moving direction of the canvas which is indicated by an arrow in FIG. 1, so that unclean portions be not left on the surface of the canvas. In result, the injection head 100 can uniformly clean the canvas over the entire surface to provide the best cleaning function.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

As apparent from the above description, the present invention can improve the cleaning function of the canvas and prevent the secondary contamination of the canvas and the periphery equipments, in relation to a conventional canvas cleaning apparatus including a rectangular container only for receiving and discharging the wastes detached from the canvas by the pressurized water injected from the injection head of the cleaning water injection unit and waterdrops scattered from the canvas. In addition, it prevents the waterdrops and wastes from being scattered into the worksite, thereby cleaning the worksite.

In order to control the revolution of the outer rotator and inner rotator, the present invention can adjust the magnetic force between the magnetic rings by moving the outer stator to easily and precisely adjust the revolution of the rotators, in relation to a conventional injection head capable of adjusting pressure of a pump. Therefore, the duration of the pump is increased, and the revolution of the rotators can be easily controlled.

What is claimed is:

1. A canvas cleaning apparatus for use in a paper mill, the apparatus comprising:

a main injection unit for injecting cleaning water installed to a base frame supporting a canvas which is rotated in contact with a main roller and an auxiliary roller, and including a rectangular housing having a length longer than that of the canvas, a reduction gear, installed to a motor installed in a housing, for reducing a rotating speed of the motor, a slider fixed to a wire wound around a sieve rotated by the reduction gear and moved from side to side along a rail installed horizontally, a bracket fixed to the slider, a caterpillar for protecting a suction hose, a cable and a pressurized water supplying pipe, and an injection head connected to the pressurized water supplying pipe;

an auxiliary injection unit for injecting the cleaning water, including a bracket fixed to the bracket of the main injection unit, a suction pipe welded to the bracket and connected to the suction hose for sucking waterdrops, which are injected at high pressure from the injection head and scattered from the canvas, to discharge the sucked waterdrops to the suction hose, a housing connected to the suction pipe enclosing the injection head and having a hole formed toward a front portion of the injection head, and a supporting frame fixed to both sides of the housing and having a permanent magnet at one end thereof, wherein the auxiliary injection unit is moved from side to side together with the bracket;

a main suction unit for sucking cleaning water and wastes installed at a position opposed to the main injection unit on the base frame supporting the canvas which is rotated in contact with a main roller and an auxiliary roller, and including a rectangular housing having a length longer than that of the canvas, a slider moved from side to side along a rail installed horizontally in the housing, a bracket fixed to the slider, and a caterpillar, fixed to the bracket, for protecting a suction hose, a cable and a pressurized water supplying pipe; and an auxiliary suction unit for sucking cleaning water and wastes, including a bracket fixed to the bracket of the main suction unit, a suction pipe welded to the bracket and connected to the suction hose for sucking the waterdrops and the wastes passed through the canvas to discharge the sucked waterdrops and wastes to the suction hose, which the waterdrops are injected at high pressure from the injection head and scattered from the canvas, a housing connected to the suction pipe and having a hole for sucking the cleaning water injected from the injection head and the wastes detached from the canvas by the cleaning water in large quantities, and a supporting frame fixed to both sides of the housing and having a permanent magnet at one end thereof, wherein the auxiliary suction unit is installed at a position opposite to the auxiliary injection unit;

wherein the auxiliary suction unit and the auxiliary injection unit are faced to each other and moved from side to side at the same speed by magnetic force of the permanent magnet of the auxiliary suction unit and the permanent magnet of the auxiliary injection unit, with the canvas being interposed between the auxiliary suction unit and the auxiliary injection unit, and the cleaning water injected from the injection head and the wastes detached from the canvas are sucked and discharged through the auxiliary suction unit and the auxiliary injection unit.

2. The apparatus as claimed in claim 1, wherein the injection head includes:

a coupler connected to the pressurized water supplying pipe;

an adapter connected to the coupler for supplying the pressurized water into a shaft;

an outer rotator having a first passage and a second through which the pressurized water supplied through a hole communicating with a pressurized water supplying passage of the shaft passes, a cleaning injection head for injecting the pressurized water passed through the first and second passages and into the canvas, a third passage formed in the first passage so that the third passage is slanted backward, and a rotatable injection head assembled to the third passage, in which the outer rotator is rotated by the pressurized water injected by the injection head;

an inner stator threadly engaged to a threaded portion of the outer rotator to rotate with the outer rotator and having a magnetic ring engaged to an outer periphery of the inner stator;

one outer stator threadly engaged to a threaded portion of the shaft and having a magnetic ring fixed to a position corresponding to the magnetic ring of the inner stator;

a spacer assembled to the shaft between the outer rotator and the inner rotator, and having a threaded portion;

the other outer stator threadly engaged to the threaded portion of the spacer, and having a magnetic ring; and an inner rotator having a first passage and a second through which the pressurized water supplied through a hole communicating with the pressurized water supplying passage of the shaft passes, a cleaning injection head for injecting the pressurized water passed through the first and second passages and into the canvas, a third passage formed in the first passage so that the third passage is slanted backward, and a rotatable injection head assembled to the third passage, in which the outer rotator is rotated by the pressurized water injected by the injection head.

* * * * *